US010655256B2

(12) United States Patent
Dei et al.

(10) Patent No.: US 10,655,256 B2
(45) Date of Patent: May 19, 2020

(54) NONWOVEN FABRIC STRUCTURE AND METHOD FOR PRODUCING THE SAME

(71) Applicants: TEIJIN LIMITED, Osaka-shi, Osaka (JP); UNISEl CO., LTD., Iwakuni-shi, Yamaguchi (JP)

(72) Inventors: Takeya Dei, Ibaraki (JP); Atsushi Suzuki, Ibaraki (JP); Naruhiko Onishi, Iwakuni (JP); Noboru Watanabe, Osaka (JP); Yasuyuki Yamazaki, Osaka (JP); Hironori Gouda, Matsuyama (JP); Yoshiyuki Tansei, Matsuyama (JP)

(73) Assignees: TEIJIN FRONTIER CO., LTD., Osaka-shi, Osaka (JP); UNISEL CO., LTD., Iwakuni-shi, Yamaguchi (JP)

( * ) Notice: Subject to any disclaimer, the term of this patent is extended or adjusted under 35 U.S.C. 154(b) by 634 days.

(21) Appl. No.: 14/421,482

(22) PCT Filed: Sep. 5, 2013

(86) PCT No.: PCT/JP2013/074603

§ 371 (c)(1),
(2) Date: Feb. 13, 2015

(87) PCT Pub. No.: WO2014/038722

PCT Pub. Date: Mar. 13, 2014

(65) Prior Publication Data

US 2015/0345055 A1 Dec. 3, 2015

(30) Foreign Application Priority Data

Sep. 7, 2012 (JP) ..... 2012-197358

(51) Int. Cl.
*D04H 3/018* (2012.01)
*D04H 1/56* (2006.01)
(Continued)

(52) U.S. Cl.
CPC ..... *D04H 3/018* (2013.01); *D01D 5/08* (2013.01); *D01D 5/20* (2013.01); *D01D 5/247* (2013.01);
(Continued)

(58) Field of Classification Search
CPC ..... D04H 3/018; D04H 1/4391; D04H 1/542; D04H 1/541; D04H 1/56; D04H 1/724;
(Continued)

(56) References Cited

U.S. PATENT DOCUMENTS 4,483,897 A * 11/1984 Fujimura ..... D04H 1/54 428/340
4,485,141 A * 11/1984 Fujimura ..... D01D 5/247 264/45.9
(Continued)

FOREIGN PATENT DOCUMENTS

CN 85109642 A 6/1986
CN 1293271 A 5/2001
(Continued)

OTHER PUBLICATIONS

Tolinski, Michael. Additives for Polyolefins: Getting the Most Out of Polypropylene, Polyethylene and TPO. Technology & Engineering. Sep. 22, 2009. p. 197-198.*
(Continued)

*Primary Examiner* — Jennifer A Gillett
(74) *Attorney, Agent, or Firm* — Sughrue Mion, PLLC

(57) ABSTRACT

Provided is a nonwoven fabric structure containing an odd-shaped fiber. The odd-shaped fiber has bubbles inside and has a cross-sectional shape that is an irregular, non-circular cross-section. Further, it is preferable that the cross-sectional shape of the odd-shaped fiber changes in the fiber length direction, the odd-shaped fiber has a crystallinity of 40% or less, and the odd-shaped fiber is made of at least two
(Continued)

kinds of thermoplastic resins. It is also preferable that that the nonwoven fabric structure contains a heat fusible fiber, the odd-shaped fiber is present in the form of a net-like fiber sheet, and the odd-shaped fiber is in the form of short fibers. In addition, a method for producing such a nonwoven fabric structure is a method in which a thermoplastic resin containing a foaming agent is extruded through a slit die to give an odd-shaped fiber having bubbles inside, followed by three-dimensional shaping.

12 Claims, 3 Drawing Sheets

(51) Int. Cl.

| | |
|---|---|
| ***D04H 1/724*** | (2012.01) |
| ***D04H 3/005*** | (2012.01) |
| ***D04H 3/03*** | (2012.01) |
| ***D04H 3/16*** | (2006.01) |
| ***D04H 5/06*** | (2006.01) |
| ***D01F 1/08*** | (2006.01) |
| ***D04H 1/4391*** | (2012.01) |
| ***D04H 1/542*** | (2012.01) |
| ***D01F 6/92*** | (2006.01) |
| ***D04H 1/541*** | (2012.01) |
| ***D01F 6/46*** | (2006.01) |
| ***D01D 5/08*** | (2006.01) |
| ***G10K 11/162*** | (2006.01) |
| ***D01D 5/253*** | (2006.01) |
| ***D01D 5/20*** | (2006.01) |
| ***D01D 5/247*** | (2006.01) |

(52) U.S. Cl.
CPC ..... *D01D 5/253* (2013.01); *D01F 1/08* (2013.01); *D01F 6/92* (2013.01); *D04H 1/4391* (2013.01); *D04H 1/541* (2013.01); *D04H 1/542* (2013.01); *D04H 1/56* (2013.01); *D04H 1/724* (2013.01); *D04H 3/005* (2013.01); *D04H 3/03* (2013.01); *D04H 3/16* (2013.01); *D04H 5/06* (2013.01); *G10K 11/162* (2013.01); *D01F 6/46* (2013.01); *D10B 2321/021* (2013.01); *D10B 2321/022* (2013.01); *D10B 2331/042* (2013.01); *D10B 2401/08* (2013.01); *D10B 2503/00* (2013.01); *D10B 2505/12* (2013.01); *Y10T 442/184* (2015.04); *Y10T 442/612* (2015.04)

(58) Field of Classification Search
CPC ..... D04H 3/005; D04H 3/03; D04H 3/16; D04H 5/06; D01D 5/20; D01D 5/253; D01D 5/247; D01D 5/08; D10B 2401/10; D10B 2321/021; D10B 2321/022; D10B 2331/042; D10B 2401/08; D10B 2503/00; D10B 2505/12; G10K 11/162; D01F 6/46; D01F 1/08; D01F 6/92; Y10T 442/184; Y10T 442/612
USPC ..... 442/339
See application file for complete search history.

(56) References Cited

U.S. PATENT DOCUMENTS

| | | | | |
|---|---|---|---|---|
| 4,865,786 | A | 9/1989 | Shibukawa et al. | |
| 5,498,468 | A * | 3/1996 | Blaney | D01D 5/253 156/167 |
| 6,410,139 | B1 * | 6/2002 | Tsutsui | D01D 5/24 428/370 |
| 6,508,897 | B1 | 1/2003 | Yamaguchi et al. | |
| 6,790,870 | B1 * | 9/2004 | DeSimone | B29C 44/348 264/50 |
| 6,983,515 | B1 | 1/2006 | Jirsak et al. | |
| 2003/0054721 | A1 * | 3/2003 | Yamaguchi | B01D 39/163 442/411 |
| 2003/0176131 | A1 * | 9/2003 | Tilton | D04H 5/06 442/361 |
| 2005/0221075 | A1 * | 10/2005 | Travelute, III | D01D 5/247 428/317.9 |
| 2010/0173547 | A1 * | 7/2010 | Katayama | C04B 16/0633 442/1 |
| 2010/0291213 | A1 * | 11/2010 | Berrigan | D04H 1/42 424/484 |
| 2011/0117353 | A1 * | 5/2011 | Henshaw | D02G 3/443 428/221 |

FOREIGN PATENT DOCUMENTS

| | | | |
|---|---|---|---|
| CN | 102574068 | B | 5/2015 |
| JP | 47-36833 | B1 | 9/1972 |
| JP | 47-39933 | B1 | 10/1972 |
| JP | 48-29490 | B1 | 9/1973 |
| JP | 57-133212 | A | 8/1982 |
| JP | 61-89320 | A | 5/1986 |
| JP | 2002069824 | A | 3/2002 |
| JP | 2002161464 | A | 6/2002 |
| JP | 2002516932 | A | 6/2002 |
| JP | 2002-249973 | A | 9/2002 |
| JP | 2002249973 | A | 9/2002 |
| JP | 2004145180 | A | 5/2004 |
| JP | 2008-44860 | A | 2/2008 |
| JP | 2012-112072 | A | 6/2012 |

OTHER PUBLICATIONS

Okuno, T, T, Yasuda, and H. Yasuda. Effect of Crystallinity of PET and Nylon 66 Fibers on Plasma Etching and Dyeability Characteristics, Textile Research Journal vol. 62 Issue 8, pp. 474-480, Aug. 1, 1992.*

Indukuri, Kishore and Alan Lesser. Comparative deformational characteristics of poly(styrene-b-ethylene-co-butylene-b-styrene) thermoplastic elastomers and crosslinked natural rubber, Polymer 46 (2005) pp. 7218-7229.*

Kreith, Frank Goswami, D. Yogi. (2004). CRC Handbook of Mechanical Engineering (2nd Edition). Taylor & Francis.*

Kamide, Kenji and Tornio Kuriki, Structural Factor Governing Dyeability of Poly(ethylene terephthalate) Fibers, Polymer Journal, vol. 19, No. 3 pp. 315-322 (1987).*

Qian, Zhi Yong et al., Synthesis and in Vitro Degradation Study of Poly(ethylene terephthalate)/Pol(ethylene glycol) (PET/PEG) Multiblock Copolymer, Polymer Degradation and Stability 83 pp. 93-100 (2004).*

Wittcoff, Harold A. Reuben, Bryan G. Plotkin, Jeffrey S.. (2013). Industrial Organic Chemicals (3rd Edition). John Wiley & Sons.*

Plastics Design Library Staff. (1995). Permeability and Other Film Properties of Plastics and Elastomers. William Andrew Publishing/Plastics Design Library.*

Selke, Susan E. M. Culter, John D.. (2016). Plastics Packaging—Properties, Processing, Applications, and Regulations (3rd Edition). Hanser Publishers.*

Communication dated Dec. 30, 2015 from the State Intellectual Property Office of the P.R.C. in counterpart application No. 201380046677.2.

International Search Report for PCT/JP2013/074603 dated Dec. 24, 2013 [PCT/ISA/210].

* cited by examiner

NONWOVEN FABRIC STRUCTURE AND METHOD FOR PRODUCING THE SAME

CROSS REFERENCE TO RELATED APPLICATIONS

This application is a National Stage of International Application No. PCT/JP2013/074603, filed on Sep. 5, 2013 (which claims priority from Japanese Patent Application No. 2012-197358, filed on Sep. 7, 2012), the contents of which are incorporated herein by reference in their entirety.

TECHNICAL FIELD

The present invention relates to a nonwoven fabric structure having excellent sound-absorbing properties and heat-insulating properties. The invention further relates to a thick nonwoven fabric structure containing an odd-shaped fiber and also to a method for producing the same.

BACKGROUND ART

Conventionally, thick fiber structures have been widely used as sound-absorbing materials or heat-insulating materials for vehicles, houses, expressways, and the like. For example, sound-absorbing materials and heat-insulating materials containing various kinds of fibers, such as glass wool, urethane foam, and polyester fibers, are known. Characteristics required for such structures include sound-absorbing properties, heat-insulating properties, lightweight properties, and the like. In particular, as well as excellent heat-insulating properties, with respect to sound-absorbing properties, excellent sound-absorbing characteristics over a wide range from a low frequency to a high frequency are required.

The most common technique to satisfy the required characteristics, such as sound-absorbing properties and heat-insulating properties, is a method that simply reduces the fiber diameter or increases the areal weight. However, by simply reducing the fiber diameter, although certain frequencies can be dealt with, it has been difficult to deal with a wide range of frequencies. In addition, the increase of the areal weight has problems in that the lightweight properties are impaired, or the density becomes too high, resulting in low air permeability, whereby sound is reflected, and the sound-absorbing properties are rather reduced.

Thus, for example, various techniques of combining a plurality of fiber structures have been proposed. This is the idea that a plurality of fiber structures are laminated, for example, with the constituent fiber fineness or the like being varied among fiber structures, thereby satisfying required properties. For example, Patent Document 1 proposes a sound-absorbing structure obtained by laminating a nonwoven fabric having an average constituent fiber fineness of 0.1 to 2 dtex and a fiber structure having an average fineness of 0.5 to 10 dtex. In addition, Patent Document 2 proposes a lightweight sound-absorbing material obtained by integrally laminating a melt-blown nonwoven fabric having a fiber diameter of 6 μm or less and a short-fiber nonwoven fabric having a fiber diameter of 7 to 40 μm. Patent Document 3 proposes a sound-absorbing material obtained by laminating a melt-blown nonwoven fabric composed of fine fibers and a spun-bonded nonwoven fabric having a single-fiber fineness of 1 to 11 dtex.

However, there have been problems in that it is difficult to ensure adhesion during lamination, or a processing step is indispensable, leading to increased cost. In addition, because only a few kinds of fibers are combined, it has been difficult to sufficiently deal with a wide range of frequencies. The shape of a structure has been getting complicated for the mounting of various electronic components, etc., which is particularly notable in vehicle applications, and thus a structure having excellent shaping properties has been desired. However, in such a laminated structure, peeling, wrinkling, or the like occurs at the lamination interface, and it has been difficult to form various shapes with high quality.

In addition, as a method for the industrial mass production of thin fibers, melt-blown nonwovens fabrics and spun-bonded nonwoven fabrics as mentioned above are known. However, there have been problems in that such a method is a special production method in which a nonwoven fabric is directly formed on a net or the like, and also, with respect to the obtained nonwoven fabric, only a relatively thin nonwoven fabric can be obtained. That is, the problems in the laminating/processing step mentioned above have not yet been solved.

Thus, generally, heavy, thick fiber structures have been widely used to satisfy the sound-absorbing or heat-insulating characteristics. In particular, with respect to the ensuring of heat-insulating properties which are significantly affected by the thickness of the nonwoven fabric, a thick nonwoven fabric structure composed of fibers having a relatively high fineness has still been the mainstream.

The development of a fiber structure that sufficiently satisfies various characteristics, such as sound-absorbing properties, heat-insulating properties, and lightweight properties, and is easy to produce has been awaited.

(Patent Document 1) JP-A-2004-145180
(Patent Document 2) JP-A-2002-161464
(Patent Document 3) JP-A-2002-69824

DISCLOSURE OF THE INVENTION

Problems that the Invention is to Solve

An object of the invention is to provide a nonwoven fabric structure having excellent sound-absorbing properties and heat-insulating properties together with excellent lightweight properties.

Means for Solving the Problems

The nonwoven fabric structure of the invention is a nonwoven fabric structure containing an odd-shaped fiber and characterized in that the odd-shaped fiber has bubbles inside and has a cross-sectional shape that is an irregular, non-circular cross-section.

Further, it is preferable that the cross-sectional shape of the odd-shaped fiber changes in the fiber length direction, the odd-shaped fiber has a crystallinity of 40% or less, the odd-shaped fiber is made of at least two kinds of thermoplastic resins, and the odd-shaped fiber contains at least two kinds of thermoplastic resins having melting points that are at least 30° C. apart from each other. It is also preferable that the nonwoven fabric structure contains a heat fusible fiber, the odd-shaped fiber is present in the form of a net-like fiber sheet, and the odd-shaped fiber is in the form of short fibers. It is preferable that the odd-shaped fiber is obtained by melting an article that integrates at least two kinds of thermoplastic resins and forming the melt into a fiber, fibers making up the nonwoven fabric structure form a wave-like folded structure, and fibers making up the nonwoven fabric structure are heat-fused.

A method for producing a nonwoven fabric structure according to another embodiment of the invention is characterized in that a thermoplastic resin containing a foaming agent is extruded through a slit die to give an odd-shaped fiber having bubbles inside, followed by three-dimensional shaping. Further, it is preferable that the thermoplastic resin is a mixture of at least two kinds, the three-dimensional shaping is performed using a heat fusible fiber together with the odd-shaped fiber, and the odd-shaped fiber is extended after extrusion.

Further, it is preferable that the odd-shaped fiber is cut into the form of short fibers, the thermoplastic resin is obtained by melting a used article, and the three-dimensional shaping forms a wave-like folded structure.

Advantage of the Invention

The invention provides a nonwoven fabric structure having excellent sound-absorbing properties and heat-insulating properties together with excellent lightweight properties.

Figure 2:
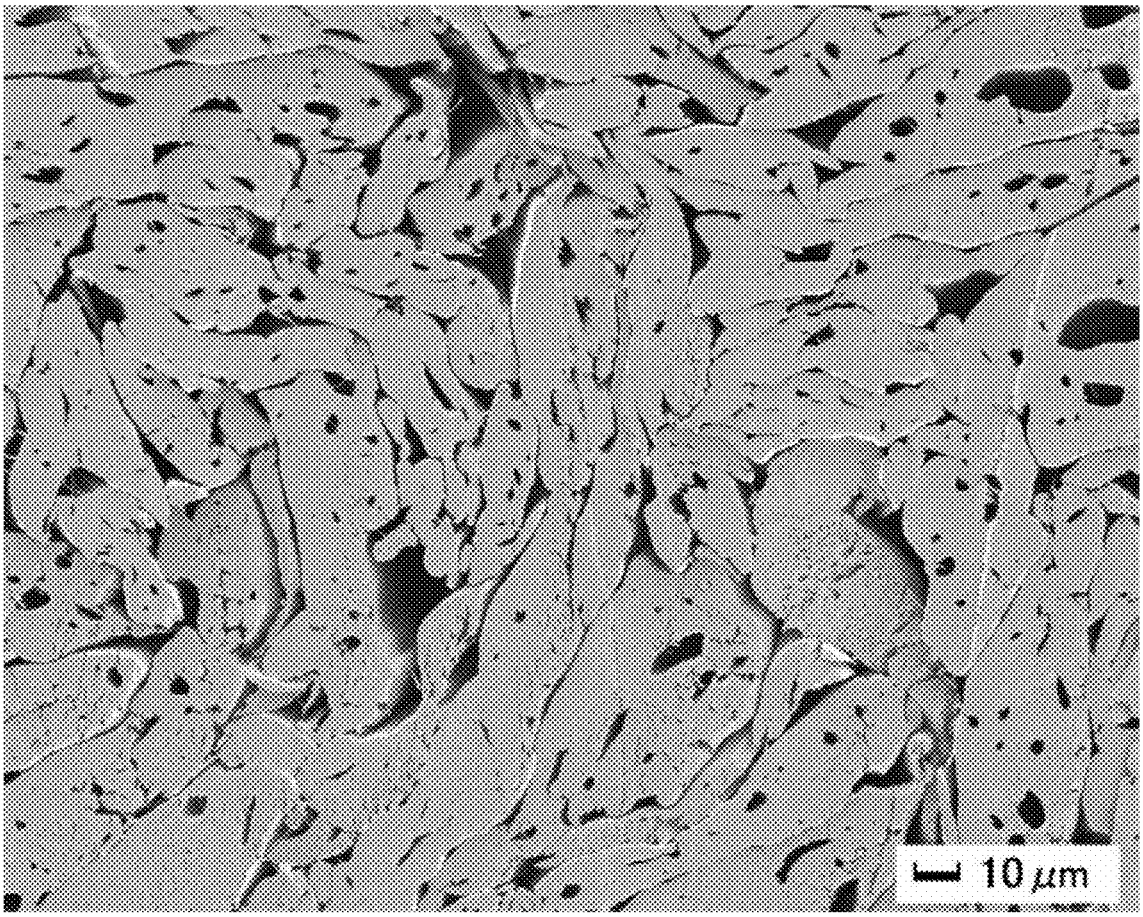

With respect to the odd-shaped fiber used for the nonwoven fabric structure of the invention, odd-shaped fibers were discharged from a nozzle, bundled, and cut;

FIG. 2 is an electron micrograph (SEM) that observes the cut cross-section of the bundle of a large number of fibers.

Figure 3:
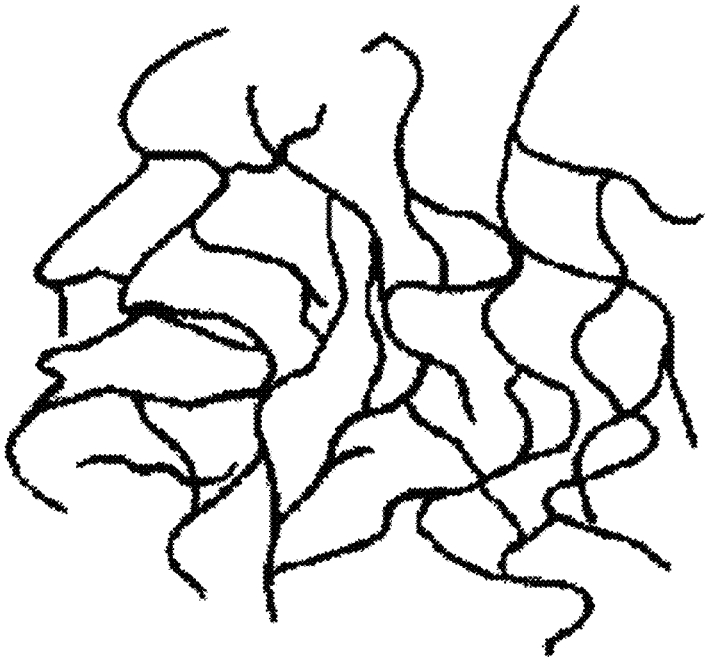

FIG. 3 schematically shows the random branching of a fiber contained in the nonwoven fabric structure, which is a preferred mode of the invention.

Figure 4:
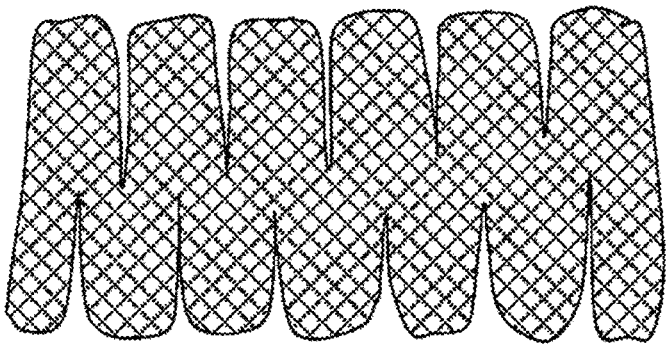

FIG. 4 schematically shows a wave-like folded structure of the nonwoven fabric structure, which is a preferred mode of the invention.

EXPLANATION OF REFERENCE NUMERALS

1: Fiber
2: Hollow portion
3: Circumscribed circle of fiber transverse cross-section
4: Inscribed circle of fiber transverse cross-section

BEST MODE FOR CARRYING OUT THE INVENTION

Hereinafter, the invention will be described in further detail.

The nonwoven fabric structure of the invention contains an odd-shaped fiber. It is preferable that the odd-shaped fiber is a synthetic fiber whose odd shape can be controlled. It is preferable that the thermoplastic resin that forms such a synthetic fiber has a melting point within a range of 70 to 350° C., more preferably 90 to 300° C., and particularly preferably 80 to 280° C. A thermoplastic resin having a melting point within such a range can be easily formed into fibers and thus is preferable. In the invention, it is also preferable to use two or more kinds of thermoplastic resins having, when mixed, a melting point within this range.

More specifically, as thermoplastic resins, polyolefin resins can be arbitrarily selected from homopolymers such as polyethylene, polypropylene, and polymethylpentene and olefinic copolymers. Examples of polyester resins include polyethylene terephthalate, polytrimethylene terephthalate, polybutylene terephthalate, polyethylene naphthalate, polylactic acid, and copolyesters thereof. Examples also include homopolymers or copolymers of two or more kinds obtained from, as starting materials, styrene, acrylic ester, vinyl acetate, acrylonitrile, vinyl chloride, etc., such as Nylon 6, Nylon 66, and like polyamides and copolymers thereof, as well as bisphenol polycarbonate, polyacetal, polyphenylene sulfide, various polyurethanes, etc. Incidentally, they may also be produced from bio-sourced raw materials.

In particular, as a thermoplastic resin used in the invention, it is preferable that a high-melting-point resin having a melting point of 180° C. or more is contained. Specific examples thereof include polyester resins. When such a high-melting-point resin is contained, a high heat-setting temperature can be employed, and shaping properties are significantly improved.

In addition, in the case where the fiber is made of two or more kinds of thermoplastic resins, it is preferable that the difference in melting point between any two kinds of thermoplastic resins is 30° C. or more. Further, it is preferable the lower-melting-point thermoplastic resin has a melting point of less than 180° C., still more preferably within a range of 80 to 160° C. In addition, it is preferable the higher-melting-point thermoplastic resin has a melting point of 180° C. or more, still more preferably within a range of 200 to 300° C.

An example of such a combination of two kinds of resins is a combination of a low-melting-point polyolefin resin and a high-melting-point polyester resin. A combination of a low-melting-point polyethylene resin and a high-melting-point polyethylene terephthalate resin is particularly preferable. It is preferable that the ratio between a low-melting-point thermoplastic resin and a high-melting-point thermoplastic resin is within a range of 10:90 to 90:10.

In the case where at least two kinds of thermoplastic resins having a melting point difference of 30° C. or more from each other are used like this, even when thermal bonding is performed in a subsequent step, the simultaneous melting of all odd-shaped fibers can be avoided. Odd-shaped fibers are partially bonded, making it easy to appropriately maintain the shape of the nonwoven fabric structure.

Further, in the case where three or more kinds of thermoplastic resins are used, when, for example, propylene which is a polyolefin resin having high orientation/crystallinity is used as a low-melting-point thermoplastic resin, process stability during spinning, etc., or stability in the subsequent stretching step, such as extension, is improved, and this is thus preferable.

According to a preferred mode of the invention, two or more kinds of thermoplastic resins are used. As a result, the shape oddness of the obtained fiber can be adjusted more easily. In addition, with respect to the dispersion state of the thermoplastic resins in the odd-shaped fiber, it is preferable that they are finely dispersed. When each component is finely dispersed, the shape and physical properties of odd-shaped fibers can be made uniform, allowing for the production of stable industrial products.

In addition, it is preferable that the fiber has a sea-island structure, in which one of thermoplastic resins forms an island structure, while the other thermoplastic resin forms a sea component. It is preferable that the island component has a fine structure with a size of 0.01 to 5.0 μm. It is particularly preferable that fine island components of 0.05 to 3.0 μm are in a finely dispersed state.

When in such a finely dispersed state, several components having different compositions are uniformly, finely dispersed, and stress can be shared by the entire fiber without deviation.

Accordingly, the obtained odd-shaped fiber has improved strength.

In addition, an interface is present between a plurality of resins in the fiber, for example, between a sea component and an island component. Because of the presence of such an interface, in addition to resistance to friction against the fiber surface at the time of the passing of air having sound energy, the sound energy is converted into vibration energy of the vibration of the interface, which contributes to the improvement of sound-absorbing performance.

Further, as the thermoplastic resin used in the invention, a recycled product can be used. Examples of recycled products herein include those obtained by melting or repelletizing defective pieces of textile products produced in various processes, such as spinning/stretching steps, weaving/knitting steps, and a nonwoven fabric step, and also those obtained by melting or repelletizing cut pieces of thermoplastic resin products produced in the production of such textile products or in a shaping step or the like using a fiber structure. The use of a recycled product, such as these repelletized products, as a thermoplastic resin used in the invention is a preferred mode. When such textile products in the course of various processes, which are to be disposed, are reused, this leads to the effective reuse of earth resources. Further, repelletization eliminates the necessity of increasing the molecular weight of a low-molecular-weight compound raw material (polymerization), and thus production energy cost is also reduced. Further, as a textile product to be reused, in addition to those made of a single polymer, it is also possible to use a product that integrates a plurality of components as mentioned above.

Incidentally, the above resin may also contain various stabilizers, flame retarders, UV absorbers, thickening branching agents, delusterants, colorants, various other improvers, etc., as necessary.

Figure 1:
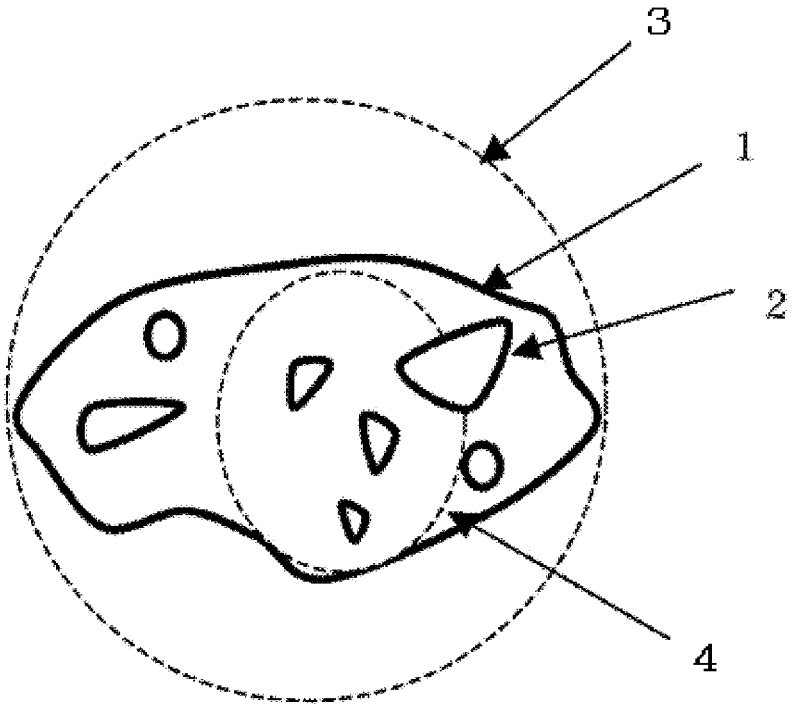
FIG. 1 schematically shows an example of a cross-section of a fiber contained in the nonwoven fabric structure of the invention.

It is preferable that the odd-shaped fiber used in the invention is a fiber made of such a resin. Meanwhile, it is necessary that the odd-shaped fiber used in the invention has bubbles inside, and that the cross-sectional shape of the odd-shaped fiber is an irregular, non-circular cross-section. For example, a fibrous material having discontinuous bubbles inside and also having an irregular, non-circular cross-section as schematically shown in FIG. 1 is preferable. More specifically, as shown by the electron micrograph of FIG. 2, a fibrous material having a plurality of different-shaped bubbles inside and also having a flat shape is preferable.

Incidentally, a bubble inside the odd-shaped fiber herein refers to a closed space present inside the fiber (void). A void inside a synthetic fiber is usually a void having a continuous, same cross-sectional shape in the fiber axis direction, such as those seen in hollow fibers, etc. Unlike this, voids in the invention are in the form of discontinuous bubbles. In the invention, it is preferable that such discontinuous bubbles, whose cross-sectional shape differs in the fiber length direction, are present inside the fiber. In the case where voids in the form of discontinuous bubbles are present, which is a preferred form of the invention, unlike the case of a normal continuous void, the convection of air does not occur. This makes it possible to keep heat conductivity lower than in the case of a continuous void. Further, also in the production process of such odd-shaped fibers, because of the presence of the closed spaces, the productivity is excellent without yarn breakage, etc., and also high heat-insulating properties and sound-absorbing properties can be exerted.

The odd-shaped fiber used in the invention has bubbles inside the fiber as mentioned above, and it is preferable that the hollowness in a single-fiber transverse cross-section is within a range of 0.5 to 40%. Hollowness herein means, in the case where a plurality of bubbles are present in a fiber cross-section, the percentage of the total area of bubbles in the fiber cross-section. The hollowness of the odd-shaped fiber is still more preferably within a range of 1 to 30%, particularly preferably 2 to 5%. In addition, it is preferable that the size of each bubble is within a range of 0.1 to 100 μm. The size is particularly preferably within a range of 0.5 to 50 μm. Lightweight properties are improved with an increase in the void hollowness. However, in the case where the hollowness is too high, the strength of the nonwoven fabric structure decreases. In addition, in the production process of the odd-shaped fiber, such as spinning, or in the subsequent shaping step, fiber breakage tends to occur often, resulting in a decrease in production efficiency.

In addition, with respect to an outer cross-section of the odd-shaped fiber of the invention, an irregular, non-circular cross-section does not only mean that the cross-section is not circular. The cross-section does not have an elliptical, regular polygonal, or like regular shape either and is disordered in shape. In an ordinary synthetic fiber, the cross-sectional shape depends on the shape of the spinneret, and thus it generally has a regular cross-section. This is because when the nozzle has an irregular shape, the frequency of yarn breakage during melt-spinning increases. However, in the case where the odd shape of a cross-section is regular, when a nonwoven fabric is formed, it may happen that the odd-shaped portion of the fiber receives another fiber, whereby the packing density is maximized, resulting in the reduction of voids. It is preferable that the odd-shaped fiber of the invention is, unlike the above, a fiber whose cross-sectional shape does not depend on the nozzle shape. For example, as mentioned below, an odd-shaped fiber obtained by slit-spinning using a foaming agent is preferable. When the fiber has such an irregular outer cross-section, a void is always created at a portion where odd-shaped fibers overlap with each other. In addition, interfiber voids also have various shapes. That is, voids between fibers are not uniform, and also there is less overlapping of fibers. In addition, because of the irregular shape, the resulting bending rigidity or substance density is random. Because of this randomness, the transfer of vibration or heat, which generally has certain directivity, can be dealt with for a wide spectrum of vibration frequencies (natural frequencies) or heat-transfer rates, and high heat-insulating properties and sound-absorbing properties can be exerted.

Further, it is preferable that the odd-shaped fiber used in the invention has a shape oddness of more than 1 and 20 or less in a single-fiber transverse cross-section. The shape oddness is still more preferably 2 to 10. Here, the shape oddness of the cross-sectional shape of a fiber is a value defined by the ratio $D_1/D_2$ between the circumscribed circle diameter $D_1$ and inscribed circle diameter $D_2$ of a single-fiber transverse cross-section. With an increase in the shape oddness, generally, the ventilation resistance as a nonwoven fabric structure is improved, resulting in the improvement of sound-absorbing properties, etc., and thus the higher the better. However, when the shape oddness is too high, the packing density of the fiber is maximized, resulting in a decrease in the area of the fiber surface that produces resistance to friction against air containing sound energy, whereby high sound-absorbing properties may not be obtained, or it tends to be difficult to ensure the thickness of a fiber sheet.

Further, it is preferable that the cross-sectional shape of the odd-shaped fiber in the invention changes in the fiber length direction (fiber axis direction). Further, it is preferable that not only the outer cross-sectional shape but also the position and size of bubbles present inside the cross-section change in the fiber length direction. When the cross-sectional shape of the fiber is not only an irregular, non-circular cross-section, but also the shape changes in the fiber length direction, even more various voids are created between single fibers or inside the fiber cross-section, and high heat-insulating properties and sound-absorbing properties over a wide range of frequencies are improved.

In addition, it is preferable that the odd-shaped fiber has a crystallinity of 40% or less. The crystallinity is still more preferably within a range of 30% or less. Here, the odd-shaped fiber having a crystallinity of 40% or less may be an odd-shaped fiber made of a crystalline thermoplastic resin and may also be an odd-shaped fiber made of an amorphous thermoplastic resin. However, in the case of an odd-shaped fiber made of a crystalline thermoplastic resin, the crystallinity is still more preferably within a range of 5 to 25%. In the case of such low crystallinity, there are less crystalline portions in molecules, and vibration-damping characteristics are excellent. Thus, sound energy can be absorbed as vibration energy, making it possible to obtain high sound-absorbing properties. In addition, dyes and the like easily permeate into amorphous portions, whereby high dye affinity can be exerted. When the draft ratio or the like in the odd-shaped fiber production process is kept low, such low crystallinity can be achieved.

Further, as one form of the odd-shaped fiber used in the invention, it is preferable that a net-like fiber sheet is formed as an assembly. A net-like fiber sheet herein means a sheet in which fibers are randomly branched in a net-like fashion. In the case where fibers have a net-like external appearance like this, the fibers are intricately entangled with each other, resulting in high strength and durability together. More specifically, it is preferable that in the net-like fiber sheet, a fibrous material having discontinuous bubbles inside and also having an irregular, non-circular cross-section as schematically shown in FIG. 1 is randomly branched as shown in FIG. 3. Further, it is preferable that the net-like fiber sheet is stretched in an extending step or the like and thus is composed of high-strength fibers. When the fibers are in the form of such a net-like fiber sheet, a fiber structure that is excellent not only in terms of lightweight properties and sound-absorbing properties but also in terms of shaping properties can be obtained.

In addition, as another mode, it is also preferable that the odd-shaped fiber contained in the nonwoven fabric structure of the invention is not in the continuous net-like form as mentioned above but in the form of short fibers. To be in the form of short fibers herein does not only mean that the fiber is simply present not as a long fiber but as short fibers, but also includes that some short fibers are joined to other fibers. In the case where the fiber is in the form of short fibers, it is preferable that the fiber length is 500 mm or less. The length is still more preferably within a range of 5 to 300 mm.

When such an odd-shaped fiber formed into short fibers is passed through a carding step, etc., a uniform nonwoven fabric structure can be formed more easily. In addition, when the fiber is formed into short fibers, the fiber can be easily mixed with other short fibers, making it possible to impart various properties. However, the production of an odd-shaped fiber as used in the invention is difficult with an ordinary spinning method. Therefore, it is preferable that the above net-like fiber sheet composed of odd-shaped fibers which have bubbles inside and have a cross-sectional shape that is an irregular, non-circular cross-section is once produced, and the sheet is processed into the form of short fibers.

It is also preferable that the nonwoven fabric structure of the invention contains a heat fusible fiber. Incidentally, with respect to the heat fusible fiber herein, it is possible that one of the components forming the above odd-shaped fiber has a low melting point, and the odd-shaped fiber serves as a heat fusible fiber. However, it is preferable that a heat fusible fiber different from the odd-shaped fiber is contained.

Further, it is preferable that the heat fusible fiber is a sheath-core fiber, and the sheath part resin has a low melting point. In this case, when a hard resin having a relatively high melting point is disposed as a core part, suitable hardness can be ensured as the entire sheath-core fiber, and the fiber can be easily uniformly mixed with the odd-shaped fiber. In addition, it is preferable that the sheath part resin has a melting point within a range of 80 to 200° C. More specifically, as a heat fusible fiber that is the most suitable for use in the invention, for example, a core-sheath-type fiber where the core part is a polyester fiber such as polyethylene terephthalate, while the sheath part is a low-melting-point polyethylene, an amorphous copolyester, or the like, is preferable.

In addition, it is preferable that the heat fusible fiber is not an odd-shaped fiber but is an ordinary circular fiber. When a fiber having a circular cross-section is employed, the strength of the nonwoven fabric structure can be easily ensured. In the case where the odd-shaped fiber and the heat fusible fiber are different, the ratio between them is preferably within a range of 99:1 to 1:1. In addition, it is preferable that the heat fusible fiber has a fineness within a range of 0.1 to 50 dtex.

The nonwoven fabric structure of the invention is obtained from the above fiber. In the nonwoven fabric structure of the invention, fibers are not only nonwoven, but also the fibers form a certain structure with each other. A certain structure herein means not only that the fibers have a certain volume, but also that the fibers are bonded or entangled with each other to forma three-dimensionally stable structure. In the nonwoven fabric structure of the invention, it is preferable that the fibers are bonded or entangled with each other such that the fibers in the structure are prevented from easily fluffing or falling off. In addition, it is preferable that once the nonwoven fabric structure of the invention is shaped, such nonwoven fabric structures are not integrated by simply placing one on top of another, but each nonwoven fabric structure forms a layer and is separately present with a certain thickness.

As a shaping method for the nonwoven fabric structure of the invention, known various methods can be employed. For example, fibers may be opened, optionally blended, and then subjected to processes such as roller carding, cross-laying, and needle-punching to form a needle-punched nonwoven fabric structure. Alternatively, it is possible that fibers including the odd-shaped fiber are placed in a forming die and subjected to thermoforming to form a thermoformed nonwoven fabric structure.

In particular, as the nonwoven fabric fiber structure of the invention, it is particularly preferable that the nonwoven fabric structure is formed of thinner fiber sheets, and the fiber sheets form a wave-like folded structure. A bulky nonwoven fabric structure can be obtained from a small amount of fibers, and the resulting nonwoven fabric structure is excellent especially in terms of weight reduction. That is, as schematically shown in FIG. 4, a sheet of fibers making up the nonwoven fabric structure forms a wave-like folded structure. It is still more preferable that the wave-like folding is folded in the longitudinal direction, that is, it is preferable that the fiber sheet is oriented with respect to the thickness direction of the fiber structure. The orientation of each sheet may be perpendicular, in a dogleg shape, in a zig-zag shape, or angled orientation. Further, the structure may also be a combination thereof. In the case where the fiber sheet is not oriented with respect to the thickness direction of the fiber structure, only the surface may be fused first upon a heat treatment, resulting in insufficient bonding. It may also happen that the thickness is further reduced due to wind pressure, resulting in a product with a high areal weight.

In the case where the fiber sheet forms a wave-like folded structure like this, the fiber surface area increases, ventilation resistance is raised, and also more dead-air portions are created. As a result, sound-absorbing properties and heat-insulating properties can be significantly improved.

It is preferable that the nonwoven fabric structure of the invention has a density within a range of 5 to 250 kg/m$^3$. The density is still more preferably within a range of 8 to 100 kg/m$^3$. In addition, it is preferable that the thickness is 5 mm or more. The thickness is still more preferably within a range of 7 to 1,000 mm, particularly preferably 10 to 500 mm. As a sound-absorbing material or a heat-insulating material, it is preferable to have a certain thickness, particularly 15 mm or more, and further 20 to 200 mm.

When the density is too low, adhesion decreases, making it difficult to maintain the form of the nonwoven fabric structure. On the other hand, when the density is too high, the fiber structure itself may be extremely heavy.

Such a nonwoven fabric structure of the invention can be obtained by the method for producing a nonwoven fabric structure, which is another embodiment of the invention. Specifically, it can be obtained by a method in which a thermoplastic resin containing a foaming agent is extruded through a slit die to give an odd-shaped fiber having bubbles inside, followed by three-dimensional shaping.

As the thermoplastic resin forming the fiber herein, those mentioned above can be used, and it is further preferable that the thermoplastic resin is a mixture of two or more kinds. It is particularly preferable that one component of the thermoplastic resin has a low melting point and exhibits thermal adhesiveness at the time of subsequent shaping. It is usually extremely difficult to produce a fiber from a thermoplastic resin made of a plurality of components having different melting points. However, the method of the invention employs a special method in which a thermoplastic resin containing a foaming agent is extruded through a slit die. As a result, it has become possible to obtain a stable odd-shaped fiber without yarn breakage.

Further, the method of the invention includes a step of extruding the thermoplastic resin to form an odd-shaped fiber. In this step, the resin is once extruded into a net-like fiber sheet, and the net-like fiber sheet may be used as it is, or after extension, as a nonwoven fabric structure in the form of a net-like fiber sheet. Alternatively, as another method, it is also possible that the resin is once formed into a net-like fiber sheet and then cut into the form of short fibers, and the obtained short fibers are shaped into a nonwoven fabric structure.

In the method for producing a nonwoven fabric structure of the invention, first, in order to obtain an odd-shaped fiber, a thermoplastic resin containing a foaming agent is extruded through a slit die. The thermoplastic resin discharged through a slit die at this time is in the form of a thin sheet. Because a foaming agent has been added to the thermoplastic resin used in the invention, foaming occurs in the resin upon discharge through the slit die, and bubbles communicate to the outside of the thin sheet, whereby a net-like sheet is formed. At the same time, fibers making up the net-like sheet turn into odd-shaped fibers. On the other hand, bubbles that do not come outside and remain inside the resin form voids inside the odd-shaped fibers. FIG. 1 is a schematic diagram thereof. The electron micrograph of FIG. 2 is a cross-sectional photograph of an assembly of odd-shaped fibers resulting from this step of the invention.

Like this, in the invention, the thermoplastic resin contains a foaming agent. The foaming agent should be a foaming substance that turns into gas upon the extrusion of a molten resin through a slit die. The foaming agent is not necessarily a substance which itself foams, and the resin itself may serve as a foaming agent having the property of generating the gas. The foaming agent may also be a substance that helps gas generation. As a specific method for obtaining a net-like fiber sheet, for example, it is possible to employ a method in which an inert gas or like substance that is gas at normal temperature, such as nitrogen gas or carbonic acid gas, is kneaded into a molten thermoplastic resin; a method in which a substance that is liquid at normal temperature and turns into gas at the melting temperature of the thermoplastic resin, such as water, is kneaded with a molten thermoplastic resin; a method in which a substance that generates gas by decomposition, such as a diazo compound or sodium carbonate, for example, is kneaded with a molten thermoplastic resin; a method in which a polymer that reacts with some of a molten thermoplastic resin (e.g., polyester, polyamide) to generate gas, such as polycarbonate, for example, is kneaded with the molten thermoplastic resin; or the like.

In any method, when a thermoplastic resin in a molten state is extruded through a slit die, gas should be generated from the die together with the resin. It is preferable that the various foaming substances mentioned above and the thermoplastic resin are sufficiently kneaded before extrusion through a slit die. When the kneading is not enough, it may be difficult to obtain a net-like fiber sheet or odd-shaped fibers that are uniform and have desired physical properties.

At the same time, in the method of the invention, it is necessary that bubbles are created inside a fiber. As a foaming agent for this purpose, an inert gas is particularly suitable. In the case where an inert gas is used, under the high-temperature, high-pressure conditions during melt-spinning, a slight amount of inert gas melts into the thermoplastic resin. Then, upon extrusion through a slit die, particularly in the case where an inert gas is used, a large number of fine bubbles are created. In the invention, because of such creation of bubbles in the course of a spinning step, and further because of the elution of the dissolved inert gas, it has become possible to stably create discontinuous bubbles inside an odd-shaped fiber.

It is preferable that the resin discharged through a die is rapidly cooled. This cooling is a factor that determines the mesh size in the net-like fiber sheet stage and also the fiber diameter or shape of odd-shaped fibers finally obtained. Therefore, it is desirable that cooling is sufficiently controlled. For example, in the case where a net-like fiber sheet having a large fiber diameter and a large mesh size is to be produced, cooling should be reduced. In the case of a small fiber diameter and a small mesh size, it should be the other way around. Generally, it is preferable to employ an air-cooling method for the cooling, and the mesh size or the fiber diameter is adjusted by changing the air volume.

However, it is also possible to use liquid, such as water, or bring the sheet in contact with a cooled solid.

Further, as the method for producing a net-like fiber sheet, it is preferable that after the thermoplastic resin is extruded in a molten state through a slit die together with a foaming agent, the discharged resin is drawn at a sufficient speed. In the case where the drawing speed is not enough, the strength of the obtained net-like fiber sheet or odd-shaped fibers may be low, or, in an extreme case, a large hole may be opened in the sheet, and uniform odd-shaped fibers may not be obtained either. An indication of the drawing speed is expressed as a draft ratio, and is usually 10 or more, preferably 20 to 400. Further, it is preferable that drawing is performed at a draft ratio of 300 or less, particularly preferably 20 to 200. Here, when the draft ratio is too low, the resulting fibers tend to be too thick. On the other hand, when it is too high, yarn breakage tends to occur, making it difficult to produce a stable net-like fiber sheet. Drafting herein means to elongate fibers to orient the molecules of the resin, thereby improving strength. In addition, the draft ratio used herein is expressed by the ratio of the drawing speed relative to the linear velocity of the resin passing through the die. In the case where the below-mentioned extension is performed in the course of drawing, the speed is converted into the speed in the case of not performing extension, and the draft ratio is calculated.

Further, another method for adjusting the mesh size of a net-like fiber sheet or the fiber diameter of odd-shaped fibers used in the invention is a method that changes the melt viscosity of the resin. Examples of methods for changing the melt viscosity include a method that changes the temperature condition, a method that changes the polymerization degree of the resin, a method that uses a plasticizer, etc., a method that is a combination thereof, etc. The method that changes the temperature condition is the simplest and most preferable.

In addition, the shape oddness and hollowness of the odd-shaped fiber mentioned above and the shape of hollow voids can be adjusted with the amount of foaming substance to be added during spinning, the temperature condition, the draft ratio, etc.

It is preferable that the odd-shaped fiber of the invention goes through the above net-like fiber sheet state in the course of its production. When the fiber goes through the net-like fiber sheet form, drafting and extension at a high ratio can be easily performed, making it possible to ensure stable productivity. As a result, an odd-shaped fiber having sufficient strength was easily obtained. In the invention, it is indispensable that the odd-shaped fiber in the nonwoven fabric structure contains bubbles inside, and that its cross-sectional shape is an irregular, non-circular cross-section. However, such an odd-shaped fiber usually has low strength, and it has been extremely difficult to achieve stable industrial production. However, because the fiber once goes through the net-like fiber sheet form as mentioned above, it has become possible to stably produce an odd-shaped fiber having high strength with less yarn breakage, etc.

Further, it is also preferable that the thermoplastic resin used for the odd-shaped fiber is obtained by melting a used article. Used articles herein are articles of a wide concept including intermediates product in the course of production. Further, it may also be a recycled product integrated with a textile product. Specifically, it is preferable to use those obtained by melting or repelletizing textile products obtained in various processes, such as spinning/stretching steps, weaving/knitting steps, and a nonwoven fabric step, and also those obtained by melting or repelletizing cut pieces of thermoplastic resin products produced in the production of such textile products or resulting from a shaping step or the like using a fiber structure.

When such textile products in the course of various processes, which are to be disposed, are reused, this eliminates the necessity of increasing the molecular weight of a low-molecular-weight compound (polymerization), and thus production energy cost is also reduced. In addition, as textile products to be reused, rather than those made of a single polymer, it is preferable to use those made of a plurality of components as mentioned above. In addition, at this time, the textile product does not have to be made only of fibers, and may also contain other thermoplastic resins for the purpose of bonding or the like. Usually, a multi-component recycled/recovered polymer having two or more components undergoes frequent yarn breakage during spinning, and cannot be formed into fibers as it is. Further, the presence of even a slight amount of foreign bodies causes yarn breakage in the spinning step for a synthetic fiber, and stable production has been extremely difficult. However, in the invention, the odd-shaped fiber is produced through a net-like fiber sheet as mentioned above. Accordingly, it has become possible to stably produce an odd-shaped fiber even in the presence of a multi-component resin or some foreign bodies. However, it is preferable that the foreign body content is 10% by weight or less, particularly 1% by weight or less, relative to the entire raw material.

In addition, through the extension step mentioned below, such a net-like fiber sheet can be made into a more uniform, high-strength net-like fiber sheet.

The extension step herein is a step in which a net-like fiber sheet is stretched in the transverse direction to expand the net. Specific examples of such methods are a method in which a net-like fiber sheet is expanded in the transverse direction while holding both ends thereof, a method in which a net-like fiber sheet extruded through a circular slit is expanded in the slit diameter direction, etc. In particular, a method in which a large number of sheets are laminated and expanded in the transverse direction while holding both ends thereof is preferable. This method has higher industrial productivity as compared with other methods, and also, because lamination is performed, uniformity in the thickness direction or width direction is improved. The method for expansion in the transverse direction may be any of the above method in which expansion is performed while holding only both ends, a method in which the sheet is divided into several zones in the width direction, and each zone is expanded, other methods, etc.

In the case where the above extension is performed, one net-like fiber sheet may be extended as it is, and it is also possible that two or more sheets are laminated and extended. In the case where two or more sheets are laminated, it is preferable that the number of sheets is within a range of 2 to 2,000, preferably 10 to 1,000. Incidentally, net-like fiber sheets to be laminated may be of the same kind, and it is also possible to laminate a plurality of net-like fiber sheets produced from different kinds of polymers together. Further, it is also possible to combine a nonwoven fabric web composed of short fibers, a long-fiber nonwoven fabric such as a spun-bonded nonwoven fabric, etc.

Then, according to the method for producing a nonwoven fabric structure of the invention, the odd-shaped fiber obtained by extrusion through a slit die like this is subjected to three-dimensional shaping. At this time, a net-like fiber sheet composed of odd-shaped fibers as mentioned above may be three-dimensionally shaped as it is. However, it is also preferable that the net-like fiber sheet is once formed into short fibers, and the obtained short fibers are three-dimensionally shaped. In the latter case where the net-like fiber sheet is formed into short fibers and used, an ordinary nonwoven fabric production process, such as carding, can be employed, and an extremely uniform nonwoven fabric structure can be obtained. In addition, other kinds of fibers can also be blended, making it possible to impart various properties.

Such an odd-shaped fiber in the form of short fibers can be obtained by cutting the formed net-like fiber sheet in the length direction into net-like cut fibers, followed by opening. It is preferable that the cut length is within a range of 5 to 500 mm, particularly preferably 10 to 250 mm. Subsequently, after blending in the same manner as in the case of an ordinary short-fiber nonwoven fabric, a roller carding step and a cross-laying step are repeated, thereby forming a uniform, integrated web-like fiber sheet. Alternatively, air-laying in the air is also preferable. In the air-laying step, a web can be provided with higher random orientation properties. Incidentally, although the net-like cut fibers themselves are an odd-shaped fiber assembly having a sheet-like portion where fibers are still slightly connected in the transverse direction, in the step of making such a web-like fiber sheet, the odd-shaped fiber of the invention is formed into short fibers. However, in the invention, when the form of a net-like fiber sheet partially remains, the strength of the web is enhanced, resulting in a web with higher process-passing properties. Incidentally, in the case where the fiber is formed into short fibers like this, it is preferable that the extension of a net-like fiber sheet in the sheet width direction as mentioned above is not performed.

According to the method for producing a nonwoven fabric structure of the invention, three-dimensional shaping is finally performed to form a nonwoven fabric structure. It is preferable that three-dimensional shaping herein is performed by a method using a fiber sheet, in which the net-like fiber sheet or web-like fiber sheet composed of short fibers thus obtained is further three-dimensionally shaped. More specifically, as a three-dimensional shaping method, it is possible to employ a method in which the fiber sheet is formed into wave-like folds, a method in which the fiber sheet (web) is subjected to physical fiber entangling such as needle punching or hydro-entanglement as in the case of ordinary nonwoven fabrics, a thermoforming method in which the fiber sheet is placed in a die and thermally shaped, or the like.

In addition, in order to stabilize the shape, it is preferable that a heat fusible component is contained in the fiber sheet, and it is particularly preferable that a heat fusible fiber is contained. As a heat fusible fiber, as one example, it is possible to use a multi-component odd-shaped fiber which itself is made of two or more components, where at least one component thereof is a low-melting-point heat fusible component. In addition, as another method, it is preferable that a fiber different from the odd-shaped fiber is used as a heat fusible fiber. In particular, as a heat fusible fiber, it is preferable to use a core-sheath-type fiber, in which a high-melting-point thermoplastic resin is used as the core component, while a low-melting-point thermoplastic resin is used as the sheath component. When a high-melting-point resin is used as a core component, adhesion is added, and also the strength of the entire nonwoven fabric structure can be improved.

In particular, in the method of the invention, it is preferable to employ a method in which the above fiber sheet is used to give a wave-like folded structure. In this case, in the nonwoven fabric structure of the invention, a net-like fiber sheet or a fiber sheet formed of a short-fiber web forms a wave-like folded structure as schematically shown in FIG. 4. It is still more preferable that the wave-like folded structure is continuous in the longitudinal direction. That is, it is preferable that the net-like or web-like fiber sheet is oriented with respect to the thickness direction of the nonwoven fabric structure. The orientation may be perpendicular, in a dogleg shape, in a zig-zag shape, or angled orientation. Further, the structure may also be a combination thereof. In the case where the net-like or web-like fiber sheet is not oriented with respect to the thickness direction of the fiber structure, only the surface may be fused first upon a heat treatment, resulting in insufficient bonding. It may also happen that the thickness is further reduced due to wind pressure, resulting in a product with a high areal weight.

In the case where the net-like or web-like fiber sheet forms a wave-like folded structure like this, the number of contact points of heat-fused fibers can be reduced. Thus, the effective fiber surface area for absorbing sound energy increases, ventilation resistance is raised, and also more dead-air portions are created. As a result, sound-absorbing properties and heat-insulating properties can be significantly improved. Further, because a folded structure is formed, shaping properties and lightweight properties are also improved.

In the case where a net-like fiber sheet is used as a fiber sheet, the fiber sheet has high strength, and thus a nonwoven fabric structure that is resistant to deformation can be formed. Meanwhile, in the case where a web-like fiber sheet composed of short fibers is used as a fiber sheet, not only the boundary line of the fiber sheet but also that of each layer of the wave-like folded structure is unlikely to appear, whereby the nonwoven fabric structure is provided with an excellent uniform external appearance. This is likely to be because while in the case of a net-like fiber sheet, binding within a sheet is strong, and the boundary between net-like fiber sheets is likely to be obvious, in the case of a web-like fiber sheet, the fiber components are effectively mixed between the inside of a fiber sheet and other fiber sheets.

Preferred examples of methods for producing a nonwoven fabric structure having such a folded structure include a method in which a net-like fiber sheet, for example, is fed to a folding device using a belt or the like and then heat-treated using a heat-treating device while folding the sheet in an accordion-like fashion, whereby folds of the fiber sheet are heat-fused with each other (i.e., heat-fused fixing points are formed). For example, the device shown in JP-T-2002-516932 (the term "JP-T" as used herein means a published Japanese translation of a PCT patent application) (an example of a commercially available product is the Struto system manufactured by Struto, etc.) or the like may be used.

According to the method for producing a nonwoven fabric structure of the invention, the odd-shaped fiber peculiar to the invention obtained using the method mentioned above, for example, is subjected to three-dimensional shaping. It is preferable that the nonwoven fabric structure has a density within a range of 5 to 250 kg/m$^3$. The density is still more preferably within a range of 8 to 100 kg/m$^3$. In addition, it is preferable that the thickness is within a range of 5 mm or more, still more preferably 7 to 1,000 mm, and particularly preferably 10 to 500 mm. As a sound-absorbing material or a heat-insulating material, it is preferable to have a certain thickness, particularly 15 mm or more, and further 20 to 200 mm.

When the density is too low, adhesion decreases, and strength tends to be insufficient. On the other hand, when the density is too high, the resulting nonwoven fabric structure is heavy, and the desired weight reduction cannot be achieved.

The nonwoven fabric structure of the invention may be used in the form of a sheet attached to a desired product. In addition, because its shaping properties are excellent, it may also be used alone. The nonwoven fabric structure of the invention is suitable for use as a sound-absorbing material, a heat-insulating material, or the like for vehicles, houses, or expressways, for example. Specifically, for example, it can be suitably used as a sound-absorbing material for vehicles including automobiles, Shinkansen bullet trains, trains, etc., such as a floor sheet, a ceiling material, a door material, or an interior material, or as a sound-absorbing material, a heat-insulating material, or a shock-absorbing material for various industrial materials. Further, as long as the object of the invention is not impaired, it is also possible to suitably add an additional material, such as a sheet of a nonwoven fabric structure composed of other short fibers or a long-fiber nonwoven fabric, for example.

EXAMPLES

Next, examples of the invention and comparative examples will be described in detail, but the invention is not limited thereto. Incidentally, measurement items in the Examples were measured by the following methods.

(1) Melting Point

Using a differential scanning calorimeter (DSC-60 Plus manufactured by Shimadzu Corporation), measurement was performed at a temperature rise rate of 20° C./min to determine the melting peak. In the case where the melting temperature was not clearly observed, using a micromelting point apparatus (MP-S3 manufactured by Yanaco Kiki Kaihatsu Kenkyusho), the temperature at which the polymer softened and started flowing (softening point) was determined as the melting point. Incidentally, with n=5, the average was calculated.

(2) Shape Oddness

Using a scanning electron microscope (SEM, SU 3500 manufactured by Hitachi High-Technologies Corporation), a transverse cross-section of a fiber was observed at a magnification of 800, and the taken photograph was digitized. In the cross-sectional photograph, the ratio ($D_1/D_2$) between the diameter $D_1$ of the circumscribed circle and the diameter $D_2$ of the inscribed circle of the fiber transverse cross-section was calculated and defined as shape oddness. In addition, using the cross-sectional photograph, the size of bubbles (voids) in the transverse cross-section of the fiber was also measured.

(3) Hollowness (%)

From the digitized photograph obtained above for shape oddness, the cross-sectional area of the fiber (including hollow portions) and the hollow portion area were measured using an image analysis system Pias-2 (manufactured Pias Corporation), and hollowness (%) was calculated from the area ratio. In addition, it was checked whether voids were present in the fiber cross-sectional view thus obtained. In the case where a void was present, the length of the void was measured. The average of the number of voids in the fiber included in the obtained image was calculated and rounded off to the nearest whole number.

(4) Crystallinity $\chi c$

As a sample for the measurement of crystallinity, a fibrous material was used in the form of a single yarn, while a fiber sheet was used in the form of a short-fiber sheet. Using an X-ray diffractometer (D8-DISCOVER with GADDS Super Speed manufactured by Bruker AXS), measurement was performed within a range of 2θ=10 to 40°. Incidentally, at this time, the profile of the sample in all directions was measured. In accordance with the method of Hindeleh et al., (A. M. Hideleh and D. J. Johnson, Polymer, 19, 27 (1978)), crystallinity was determined from the percentage of the crystalline peak intensity after peak resolution relative to the total peak intensity.

(5) Measurement Method for Island Components in Single-Fiber Cross-Section

A Single Fiber or Fiber Sheet to Serve as a Sample was fixed to a sample table for a scanning electron microscope. Using a sputtering device (an ion coater IB-2 manufactured by Eiko Engineering Co., Ltd.), the sample was installed in a chamber where the upper electrode was stainless steel, while the lower electrode was the sample table. The degree of vacuum was raised to a vacuum of about 6.65 Pa ($5\times10^{-2}$ Torr), and the sample surface was ion-etched for about 30 minutes at a voltage of 0.45 kV and a current of 3 mA. Next, using a scanning electron microscope (SEM, "SU 3500" manufactured by Hitachi High-Technologies Corporation), a transverse cross-section of the fiber was observed at a magnification of 10,000, and the taken photograph was digitized.

It was checked whether a sea-island structure had been formed in the fiber cross-sectional view thus obtained. In the case where a sea-island structure had been formed, the length of an island was measured. In the case where the number of islands of 0.01 to 5.0 μm was 20 or more, they were determined to be finely dispersed.

(6) Thickness, Areal Weight, and Density of Nonwoven Fabric Structure

Measurement was performed in accordance with JIS L 1913.

(7) Non-Uniformity in Areal Weight of Nonwoven Fabric Structure in Width Direction 25-cm square samples were cut out from a nonwoven fabric structure at three points: right and left ends and the center in the width direction. Then, with respect each of the right end, the left end, and the center, measurement was performed at three points in the width direction and five points in the length direction, and the standard deviations were calculated. Each standard deviation was divided by the average, and the quotient was defined as the coefficient of variation.

(8) Sound-Absorbing Properties (Sound Absorption Coefficient)

A sample was arranged such that a nonwoven fabric structure was located on the sound source side. The sound absorption coefficient was measured as a normal incidence sound absorption coefficient in accordance with JIS-A1405 by the two-microphone technique using a multichannel analyzing system 3550 (software: two-channel analysis software BZ5087) manufactured by Bruel & Kjar. The sound absorption coefficients were compared at 1,000 Hz, 2,000 Hz, 3,150 Hz, and 4,000 Hz.

(9) Thermal Conductivity

Measurement was performed using a quick thermal conductivity meter ("QTM-500" manufactured by Kyoto Electronics Manufacturing Co., Ltd.) by the hot-wire method.

(10) Shaping Properties

As an upper die, a flat die having an outer frame size of 200 mm×200 mm was prepared. Meanwhile, as a lower die, a die having an outer frame size of 200 mm×200 mm in the form of a case having an upper size of 150 mm×150 mm×10 mm in height and a lower size of 170 mm×170 mm was prepared.

Next, each sample was treated with hot air at 180° C. for 3 minutes. Then, the gap between the outer frame dies was made 5 mm using a spacer, and cold-pressing was performed using the dies. At the time of pressing, the fiber sheet was located on the lower-die side. The external appearance of the case-shaped article was observed and evaluated according to the following criteria.

Level 3: No change is seen in the external appearance.

Level 2: Wrinkles are seen on the surface.

Level 1: Large wrinkles are seen on the surface.

Example 1

35 parts by weight of polyethylene terephthalate (PET), 35 parts by weight of polyethylene (PE), and 30 parts by weight of polypropylene (PP) were melt-mixed together with $N_2$ gas as a foaming agent. The melt was extruded from an extruder at an extrusion temperature of 170 to 350° C. and drawn with rapid cooling at the die exit to give a net-like fiber sheet. Next, the sheet was extended in the transverse direction to 10 times the original length and wound up as a net-like fiber sheet having an areal weight of 41 g/m$^2$. In the net-like fiber sheet, the size of bubbles in an odd-shaped fiber cross-section was 0.5 to 20 μm, and two bubbles on average were observed in each fiber cross-section. In addition, the constituent fiber had a shape oddness of more than 1 and 4 or less and a hollowness of 15%. The crystallinity of the fiber (odd-shaped fiber) of the net-like fiber sheet was 24%. In addition, in the odd-shaped fiber, not only the cross-sectional shape but also the number and size of bubbles changed in the length direction. Further, the odd-shaped fiber was a multi-component, sea-island fiber, and 20 or more fine islands having a diameter 0.1 to 1 μm were observed, indicating a finely dispersed state.

Next, the net-like fiber sheet was advanced by a belt. Using the Struto system manufactured by Struto, the net-like fiber sheet was folded in a wave-like fashion to cause fiber orientation in the thickness direction. Subsequently, the sheet was heat-treated at 170° C. to give a nonwoven fabric structure having an areal weight of 800 g/m$^2$ and a thickness of 20 mm. The level of shaping properties was 3. Evaluation results are shown in Table 1.

Using this nonwoven fabric structure, an automotive sound-absorbing material (floor sheet) was obtained. As a result, not only sound-absorbing properties but also shaping properties were excellent.

Example 2

70 parts by weight of copolymerized low-melting-point polyethylene terephthalate having a melting point of about 110° C. and 30 parts by weight of polypropylene (PP) were melt-mixed together with $N_2$ gas as a foaming agent. In the same manner as in Example 1, a net-like fiber sheet was obtained, then extended in the transverse direction, and wound up as a net-like fiber sheet having an areal weight of 35 g/m$^2$. In the net-like fiber sheet, the size of bubbles in an odd-shaped fiber cross-section was 0.7 to 25 μm, and two bubbles on average were observed in each fiber cross-section. In addition, the constituent fiber had a shape oddness of more than 1 and 4 or less and a hollowness of 4%. The crystallinity of the fiber (odd-shaped fiber) of the net-like fiber sheet was 21%. In addition, in the odd-shaped fiber, not only the cross-sectional shape but also the number and size of bubbles changed in the length direction. Further, the odd-shaped fiber was a two-component sea-island fiber, and 20 or more fine islands having a diameter 0.1 to 1 μm were observed, indicating a finely dispersed state.

Next, in the same manner as in Example 1, the net-like fiber sheet was folded in a wave-like fashion using the Struto system manufactured by Struto to cause fiber orientation in the thickness direction. Subsequently, the sheet was heat-treated at 160° C. to give a nonwoven fabric structure having an areal weight of 500 g/m$^2$ and a thickness of 15 mm. The level of shaping properties was 2.5. Evaluation results are shown in Table 1. The adhesion between folds was excellent.

Using this nonwoven fabric structure, an automotive sound-absorbing material (floor sheet) was obtained. As a result, not only sound-absorbing properties but also shaping properties were excellent.

Example 3

The resin material that integrates polyethylene terephthalate and polyethylene in Example 1 was once repelletized, and then 80 parts by weight of the repelletized material and 20 parts by weight of polypropylene were melt-mixed together with $N_2$ gas as a foaming agent. In the same manner as in Example 1, a net-like fiber sheet was obtained, then extended in the transverse direction, and wound up as a net-like fiber sheet having an areal weight of 35 g/m$^2$. In the net-like fiber sheet, the size of bubbles in an odd-shaped fiber cross-section was 0.6 to 30 μm, and two bubbles on average were observed in each fiber cross-section. In addition, the constituent fiber had a shape oddness of more than 1 and 4 or less and a hollowness of 4%. The crystallinity of the fiber (odd-shaped fiber) of the net-like fiber sheet was 19%. In addition, in the odd-shaped fiber, not only the cross-sectional shape but also the number and size of bubbles changed in the length direction. Further, the odd-shaped fiber was a two-component sea-island fiber, and 20 or more fine islands having a diameter 0.1 to 1 μm were observed, indicating a finely dispersed state.

Next, the net-like fiber sheet was folded in a wave-like fashion using the Struto system and heat-treated. The nonwoven fabric structure had an areal weight of 600 g/m$^2$ and a thickness of 16 mm. The level of shaping properties was 3. Evaluation results are shown in Table 1.

Using this nonwoven fabric structure, an automotive sound-absorbing material (floor sheet) was obtained. As a result, not only sound-absorbing properties but also shaping properties were excellent.

Example 4

The net-like fiber sheets prepared in Example 1 and Example 2 were prepared for rolling out from the Struto system. The sheets were rolled out to overlap with each other, then folded in a wave-like fashion, and heat-treated. The level of shaping properties was 3. The adhesion strength between folds was high. Evaluation results are shown in Table 1. In addition, using this nonwoven fabric structure, an automotive sound-absorbing material (floor sheet) was obtained. As a result, not only sound-absorbing properties but also shaping properties were excellent.

Comparative Example 1

A polyester-based spun-bonded nonwoven fabric having an areal weight of 30 g/m$^2$ was prepared. Bubbles were not contained in a cross-section of fibers making up the nonwoven fabric, and the crystallinity of the fiber nonwoven fabric was 45%. In addition, the fiber cross-section was a round cross-section.

Using this spun-bonded nonwoven fabric in place of the net-like fiber sheet of Example 1, the fabric was advanced by a belt, folded in a wave-like fashion using the Struto system manufactured by Struto to cause fiber orientation in the thickness direction, and then heat-treated at 170° C. Wave-like folding was barely possible, but the areal weight was 600 g/m$^2$, and the thickness was only 7 mm. The spun-bonded nonwoven fabric with low strength fell over at an angle. Further, folds were not bonded with each other. Thus, it was insufficient to be a fiber structure.

TABLE 1

| Nonwoven Fabric Structure (1) | | | | |
|---|---|---|---|---|
| | Example 1 | Example 2 | Example 3 | Example 4 |
| Nonwoven Fabric Structure | | | | |
| Areal Weight (g/m$^2$) | 800 | 500 | 600 | 850 |
| Thickness (mm) | 20 | 15 | 16 | 23 |
| Density (kg/m$^3$) | 40 | 33 | 38 | 37 |
| Sound Absorption Coefficient (%) | | | | |
| 1,000 Hz | 18 | 15 | 16 | 19 |
| 2,000 Hz | 36 | 28 | 30 | 38 |
| 3,150 Hz | 55 | 48 | 50 | 60 |
| 4,000 Hz | 63 | 52 | 55 | 71 |

Example 5

100 parts by weight of polyethylene terephthalate (PET) having a melting point of 270° C. was melt-mixed with $N_2$ gas as a foaming agent. The melt was extruded from an extruder at an extrusion temperature of 170 to 350° C. and drawn at a draft ratio of 100 with rapid cooling at the die exit to give a net-like fiber sheet. Further, an electrostatic oil agent was applied in an amount of 0.2% as solid, and then the net-like fiber sheet was cut to 64 mm using a continuous cutter. The net-like cut fibers were an odd-shaped fiber having a fiber shape oddness of more than 1 and 5 or less and an inscribed circle diameter $D_2$ of 1 μm minimum to 40 μm maximum. In addition, the size of bubbles in an odd-shaped fiber cross-section was 0.5 to 25 μm, and two bubbles on average were observed in each fiber cross-section. The hollowness of the fiber, which is the total bubble area relative to the cross-sectional area, was 1 to 5%. The crystallinity of the net-like cut fibers (odd-shaped fiber) was 22%. In addition, in the odd-shaped fiber, not only the cross-sectional shape but also the number and size of bubbles changed in the length direction.

Meanwhile, as a heat-fusible fiber, a core-sheath-type heat-fusible composite fiber made of an amorphous copolyester having a melting point of 110° C. as the sheath component and ordinary polyethylene terephthalate as the core component ("TJ04CN" manufactured by Teijin Limited, 2.2 dtex×51 mm, single-fiber cross-sectional shape: round cross-section) was prepared.

Using 70% by weight of the net-like cut fibers (an odd-shaped fiber) and 30% by weight of the above heat-fusible fiber having a round cross-section, the fibers were opened, blended, and then subjected to roller carding, cross-laying, and roller carding in this order to give a web (fiber sheet) that integrates the odd-shaped fiber in the form of short fibers. Next, using the Struto system manufactured by Struto, the obtained web was folded to orient most of the fibers in the thickness direction, then immediately heat-treated at 170° C., and cut. The obtained nonwoven fabric structure had a width of 75 cm, a length of 100 cm, an areal weight of 600 g/m$^2$, and a thickness of 25 mm. Here, non-uniformity in areal weight was measured. As a result, it was observed that at each of the three points, that is, right and left ends and the center in the width direction, the coefficient of variation obtained by dividing the standard deviation by the average was 5% or less. In addition, the tensile strength of the nonwoven fabric in the longitudinal direction was measured in accordance with JIS L 1913. As a result, it was 3.6 N/50 mm.

The sound-absorbing performance and thermal conductivity of the nonwoven fabric structure thus obtained are shown in Table 2.

Example 6

A net-like fiber sheet was prepared in the same manner as in Example 5, except that 50 parts by weight of polyethylene terephthalate (PET) having a melting point of 270° C. and 50 parts by weight of polyethylene (PE) having a melting point of 105° C. were used in place of 100 parts by weight of polyethylene terephthalate (PET). The sheet was cut to a length of 64 mm to give net-like cut fibers (odd-shaped fiber). The net-like cut fibers were an odd-shaped fiber having a fiber shape oddness of more than 1 and 7 or less and an inscribed circle diameter $D_2$ of 1.3 μm minimum to 36 μm maximum. In addition, the size of bubbles in an odd-shaped fiber cross-section was 0.4 to 27 μm, and three bubbles on average were observed in each fiber cross-section. The hollowness of the fiber, which is the total bubble area relative to the cross-sectional area, was 1 to 6%. Further, the odd-shaped fiber was a two-component sea-island fiber, and 20 or more fine islands having a diameter 0.1 to 1 μm were observed, indicating a finely dispersed state. The crystallinity of the net-like cut fibers (odd-shaped fiber) was 18%. In addition, in the odd-shaped fiber, not only the cross-sectional shape but also the number and size of bubbles changed in the length direction.

Further, in the same manner as in Example 5, a nonwoven fabric web (fiber sheet) was produced using 70% by weight of the obtained net-like cut fibers and 30% by weight of a heat-fusible fiber. Next, in the same manner as in Example 5, the obtained web was folded, heat-treated, and cut to give a nonwoven fabric structure having a width of 75 cm, a length of 100 cm, an areal weight of 560 g/m$^2$, and a thickness of 25 mm.

Here, non-uniformity in areal weight was measured. As a result, it was observed that at each of the three points, that is, right and left ends and the center in the width direction, the coefficient of variation obtained by dividing the standard deviation by the average was 5% or less. In addition, the tensile strength of the nonwoven fabric in the longitudinal direction was measured in accordance with JIS L 1913. As a result, it was 6.2 N/50 mm. It is likely that the polyethylene component having a low melting point contributed to thermal bonding between fibers.

The sound-absorbing performance and thermal conductivity of the nonwoven fabric structure thus obtained are shown in Table 2.

Example 7

A carpet made of two kinds of thermoplastic resins was pulverized, melt-mixed, and repelletized into pellets. In this carpet, a polyethylene terephthalate (PET) fiber having a melting point of 270° C. was used as the surface fiber, and polyethylene (PE) having a melting point of 105° C. was used as a backing sheet. They had been integrated by thermal bonding and was extremely difficult to separate. With respect to the ratio between the two kinds of thermoplastic resins, PET was parts by weight and PE was 50 parts by weight, but contamination with 0.3% by weight of foreign bodies was observed.

A net-like fiber sheet was prepared in the same manner as in Example 5, except that 70 parts by weight of the repelletized pellets made of polyethylene terephthalate (PET) and polyethylene (PE) and 30 parts by weight of polypropylene (PP) having a melting point of 160° C. were used in place of 100 parts by weight of polyethylene terephthalate (PET) of Example 5. The sheet was cut to a length of 64 mm to give net-like cut fibers (odd-shaped fiber). The net-like cut fibers were an odd-shaped fiber having a fiber shape oddness of more than 1 and 8 or less and an inscribed circle diameter $D_2$ of 0.9 μm minimum to 33 μm maximum. In addition, the size of bubbles in an odd-shaped fiber cross-section was 0.4 to 19 μm, and three bubbles on average were observed in each fiber cross-section. The hollowness of the constituent fiber, which is the total bubble area relative to the cross-sectional area, was 1 to 8%. Further, the odd-shaped fiber was a two-component sea-island fiber, and 20 or more fine islands having a diameter 0.1 to 1 μm were observed, indicating a finely dispersed state. The crystallinity of the net-like cut fibers was 16%. In addition, in the odd-shaped fiber, not only the cross-sectional shape but also the number and size of bubbles changed in the length direction.

Further, in the same manner as in Example 5, a nonwoven fabric web (fiber sheet) was produced using 70% by weight of the obtained net-like cut fibers and 30% by weight of a heat-fusible fiber. Next, in the same manner as in Example 5, the obtained web was folded, heat-treated, and cut to give a nonwoven fabric structure having a width of 75 cm, a length of 100 cm, an areal weight of 560 g/m$^2$, and a thickness of 25 mm.

Here, non-uniformity in areal weight was measured. As a result, it was observed that at each of the three points, that is, right and left ends and the center in the width direction, the coefficient of variation obtained by dividing the standard deviation by the average was 5% or less. The sound-absorbing performance and thermal conductivity of the nonwoven fabric structure thus obtained are shown in Table 2.

Comparative Example 2

A hollow cross-section fiber was used in place of the net-like cut fibers (odd-shaped fiber) of Example 5. The fiber had one continuous void in the center, and the hollowness was 40%. However, the shape of the void in the center of the hollow fiber was a shape formed by the shape of a spinneret. It was a regular circle and had no change in the length direction. The crystallinity of this hollow fiber was 52%. The single-yarn fineness was 3.5 dtex, and the length was 64 mm.

In the same manner as in Example 5 except for using 70% by weight of the hollow cross-section fiber and 30% by weight of the same core-sheath-type heat-fusible composite fiber as in Example 5, the fibers were opened, blended, and then subjected to roller carding, cross-laying, and roller carding in this order to give an integrated nonwoven fabric web (fiber sheet). Subsequently, the obtained web was folded to orient most of the fibers in the thickness direction, then immediately heat-treated at 170° C., and cut to give a fiber structure having a width of 75 cm, a length of 100 cm, an areal weight of 600 g/m$^2$, and a thickness of 25 mm.

The fiber structure thus obtained was excellent in terms of the value of thermal conductivity, but the sound-absorbing performance was inferior compared with examples. The physical properties are summarized in Table 2.

TABLE 2

Nonwoven Fabric Structure (2)

| | Example 5 | Example 6 | Example 7 | Comparative Example 2 |
|---|---|---|---|---|
| Nonwoven Fabric Structure | | | | |
| Areal Weight (g/m$^2$) | 600 | 560 | 600 | 600 |
| Thickness (mm) | 25 | 25 | 25 | 25 |
| Density (kg/m$^3$) | 24 | 22.4 | 22.4 | 24 |
| Sound Absorption Coefficient (%) | | | | |
| 1,000 Hz | 17 | 19 | 18 | 8 |
| 2,000 Hz | 37 | 39 | 39 | 18 |
| 3,150 Hz | 53 | 57 | 56 | 31 |
| 4,000 Hz | 61 | 64 | 64 | 33 |
| Thermal Conductivity (W/mK) | 0.0339 | 0.0334 | 0.0332 | 0.0384 |

The invention claimed is:

1. A nonwoven fabric structure comprising a non-circular cross-section fiber, wherein:

the non-circular cross-section fiber has bubbles inside and has a cross-sectional shape that is an irregular, non-circular cross-section, the non-circular cross-section fiber contains at least a lower-melting-point thermoplastic resin and a higher-melting-point thermoplastic resin which have melting points that are at least 30° C. apart from each other, the higher-melting-point thermoplastic resin has a melting point of 180° C. or more, the lower-melting-point thermoplastic resin is a polyolefin resin, the higher-melting-point thermoplastic resin is a polyester resin, three or more kinds of thermoplastic resins are used, a propylene resin is used as the lower-melting-point thermoplastic resin, the non-circular cross-section fiber has a sea-island structure, the sea-island structure comprises a sea component and an island component, the island component has a fine structure with a size of 0.01 to 5 μm, and the nonwoven fabric structure contains a heat fusible fiber, in which the heat fusible fiber is another fiber.

2. The nonwoven fabric structure according to claim 1, wherein the cross-sectional shape of the non-circular cross-section fiber changes in the fiber length direction.

3. The nonwoven fabric structure according to claim 1, wherein the non-circular cross-section fiber has a crystallinity of 40% or less.

4. The nonwoven fabric structure according to claim 1, wherein the non-circular cross-section fiber is present in the form of a fiber sheet in which fibers are randomly branched.

5. The nonwoven fabric structure according to claim 1, wherein the non-circular cross-section fiber is in the form of short fibers.

6. The nonwoven fabric structure according to claim 1, wherein the non-circular cross-section fiber is obtained by melting an article that integrates at least two thermoplastic resins and forming the melt into a fiber, wherein the article is a recycled product.

7. The nonwoven fabric structure according to claim 1, wherein the nonwoven fabric structure is formed of fiber sheets that form a folded structure.

8. The nonwoven fabric structure according to claim 1, wherein the nonwoven fabric structure comprises heat-fused fibers, wherein the heat-fused fibers comprise the non-circular cross-section fiber.

9. The nonwoven fabric structure according to claim 2, wherein the non-circular cross-section fiber has a crystallinity of 40% or less.

10. The nonwoven fabric structure according to claim 1, wherein the lower-melting-point thermoplastic resin has a melting point of less than 180° C.

11. The nonwoven fabric structure according to claim 8, wherein the heat-fused fiber is a sheath-core fiber comprising a sheath part resin and a core part resin, and the sheath part resin has a lower melting point than the core part resin.

12. The nonwoven fabric structure according to claim 1, wherein the heat fusible fiber is a sheath-core fiber comprising a sheath part resin and a core part resin, and the sheath part resin has a lower melting point than the core part resin.

* * * * *